US005201097A

United States Patent [19]

Phillips

[11] Patent Number: 5,201,097

[45] Date of Patent: Apr. 13, 1993

[54] ADJUSTABLE KEY FOR BUTT HINGES

[76] Inventor: Darrell R. Phillips, 97 Coveland Dr., Avon Lake, Ohio 44012

[21] Appl. No.: 854,206

[22] Filed: Mar. 20, 1992

[51] Int. Cl.[5] ..... E05D 7/04

[52] U.S. Cl. ..... 16/248; 16/248

[58] Field of Search ..... 16/248, 247, 273, 243

[56] References Cited

U.S. PATENT DOCUMENTS 1,833,972 12/1931 Olson ..... 16/243
2,532,772 12/1950 Kamfjord ..... 16/248

FOREIGN PATENT DOCUMENTS 136211 4/1985 European Pat. Off. ..... 16/273
2122679 1/1984 United Kingdom ..... 16/248

*Primary Examiner*—Robert L. Spruill
*Assistant Examiner*—Carmine Cuda
*Attorney, Agent, or Firm*—J. Helen Slough

[57] ABSTRACT

The invention relates to a guide or key to be employed with a conventional butt hinge for different positioning of one leaf with respect to the other to be adjusted to raise or lower the door without removal of the pin upon which the leaves are mounted.

3 Claims, 2 Drawing Sheets

ADJUSTABLE KEY FOR BUTT HINGES

FIELD OF THE INVENTION

This invention relates to hinges and relates more particularly to hinges for use in mounting doors, gates, panels or the like particularly to that type of hinge known in the trade as a butt hinge.

BACKGROUND OF THE INVENTION

The leaves of a butt hinge in general have interfitting axially aligned knuckles along their opposed marginal edges for receiving a pin or a pintle therethrough and as stated in U.S. Letters Pat. No. 3,991,436 to Nagase granted Nov. 16, 1976 the leaves are swingable one with respect to the other on the pintle. To provide for adjustment, or to readily install the same, or to raise or lower the door, etc. as for example to compensate for settling of the structure in which the door is installed, or like problems, hinges have been provided in the prior art, as noted above, with pivotal removable pintles or pins on which rings are selectively interleaved between the knuckles on the leaves after first removal of the pin or pintle to provide for placement of the rings, or a number of the same to substantially fill spacing between the knuckles and for selected heights of elevation or lowering the door. In U.S. Letters Pat. No. 1,141,303 to Bennett et al washers are optionally mounted in different positions upon the pin to permit vertical adjustment of a door to three different positions. In the prior art removal of the pin or pintle is required to position the rings or washers in spacing between the knuckles.

BRIEF SUMMARY OF THE INVENTION

The invention relates to the provision of a guide or key adapted for movement over a pin or pinion connecting leaves of a butt hinge, said guide or key carrying a pair of arch shaped clips or clasps adapted to be disposed as desired into selected spacing provided between certain of the knuckles of the butt hinge, the pin or pinion being fixed with respect to the knuckles during use of the guide or key which raises or lowers one leaf with respect to a second leaf to vertically raise or lower the door etc. with respect to the jamb.

DESCRIPTION OF THE PREFERRED EMBODIMENT

Figure 4:
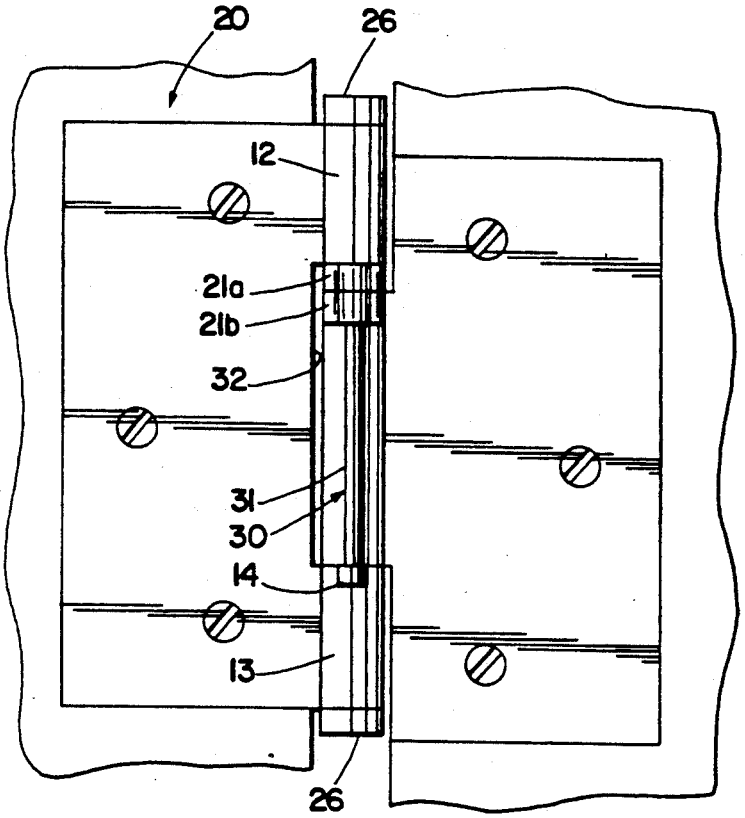
FIG. 4 is a view similar to FIG. 3 showing the clips or clasps of FIG. 3 in a combined seating of two clasps in space provided between the central knuckle and an end of an adjacent knuckle.
Figure 5:
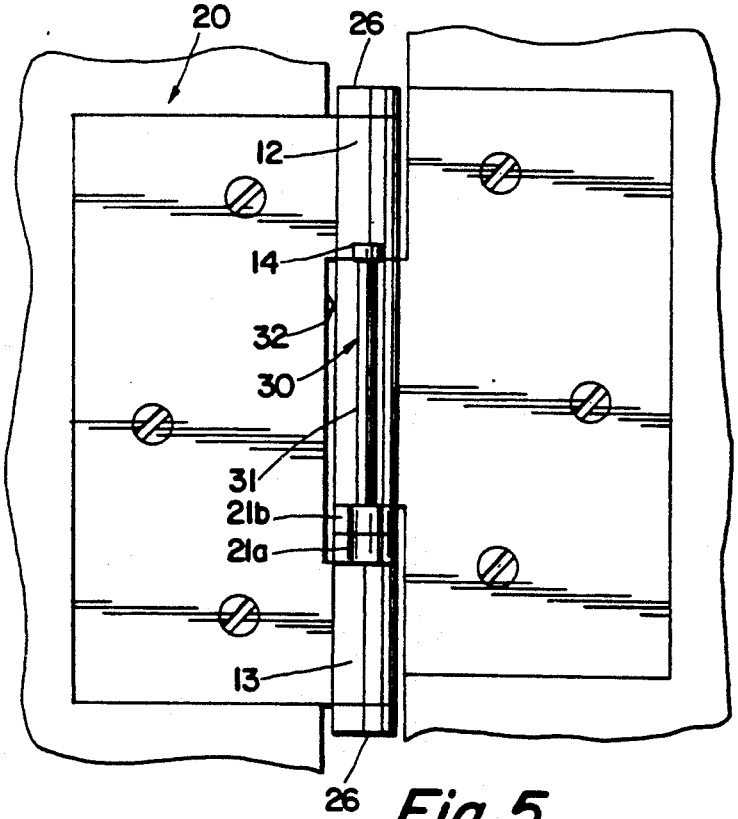
FIG. 5 is a view similar to FIG. 4 showing the clips in space provided at opposite ends of a centrally disposed knuckle.

Referring now to the drawings in all of which like parts are designated by like numerals, this invention relates to an adjustable tool or key implement 30 adapted to be used with a butt hinge 20 of preferred size which hinge has a first leaf 11 provided with knuckles 12 and 13 at opposite ends of the margins of a first leaf 11 and a relatively longer knuckle 16 projecting outwardly from a second leaf 15 and adapted to be centrally disposed between the knuckles 12 and 13 on said first leaf, all of the said knuckle being provided with a cylindrical passage or bore "b". The knuckle 12 and 13 carried by the first leaf are interspaced as stated between the centrally disposed knuckle 16. A pivot pin 25 is disposed through the openings in the knuckles and opposite ends of said pin are provided with heads or nuts 26 to wherefor the knuckles are pivotally and fixedly mounted on said pin. The knuckle 16 on the second leaf 15 is adapted to be disposed in spaced relation to one or both of the knuckles 12 and 13 on the first leaf 11 and between the axially disposed knuckles on the first, as shown in FIGS. 3, 4 and 5.

The knuckle 16 on the second leaf is shorter in length than the space 32 provided between the knuckle 12 and 13 on the first leaf. When the pin or pintle 25 is inserted into the openings provided through the knuckles of both leaves, space is provided between the centrally disposed knuckle 16 mounted on the second leaf 15 and one or both of the knuckles mounted on the first leaf.

Figure 2:
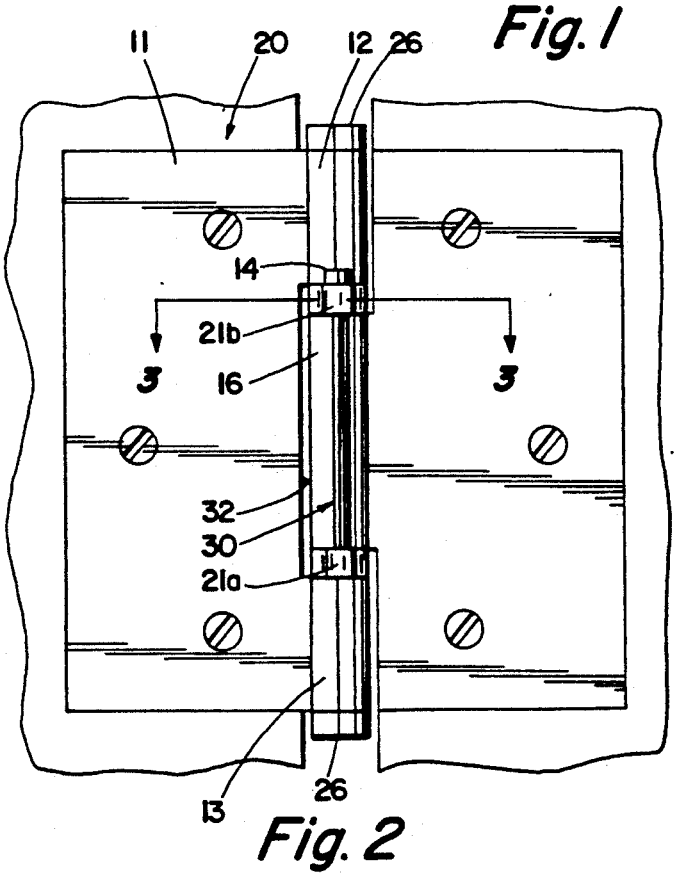
FIG. 2 is a front view of my improved construction showing the key or guide of FIG. 1 in a preferred seating in spaces between a central knuckle and end knuckles of the hinge.

A key or fastening lock 30 having a rod 31 or the like is adapted to be disposed longitudinally over the pin or pinion 25 and to carry on said rod a pair of clips or clamps 21 to close a desired space between the knuckles and said rod is provided with a projection or rolled end 14. The key is adapted to be used for locking the butt hinge in a desired position. The clips are as shown of arch shape and mounted either securely on one end of the said key or with one clip slidably movable on the rod wherefor the clips may be disposed in spaces provided between adjacent knuckles. The clips may be carried in pairs of clips in end-to-end contact, as shown in FIGS. 4 and 5 and mounted on the pin 25 to fill a relatively greater space provided between one of the end knuckles on the first leaf 11 and the intermediately disposed knuckle on the second leaf 15 or by inserting one of said clips into space provided between one end knuckle on the first leaf 11 and the centrally disposed knuckle on the second leaf 15 or space provided between a second end knuckle on the first leaf 11 and the centrally disposed knuckle 16 on the second leaf, as shown in FIG. 2.

Figure 1:
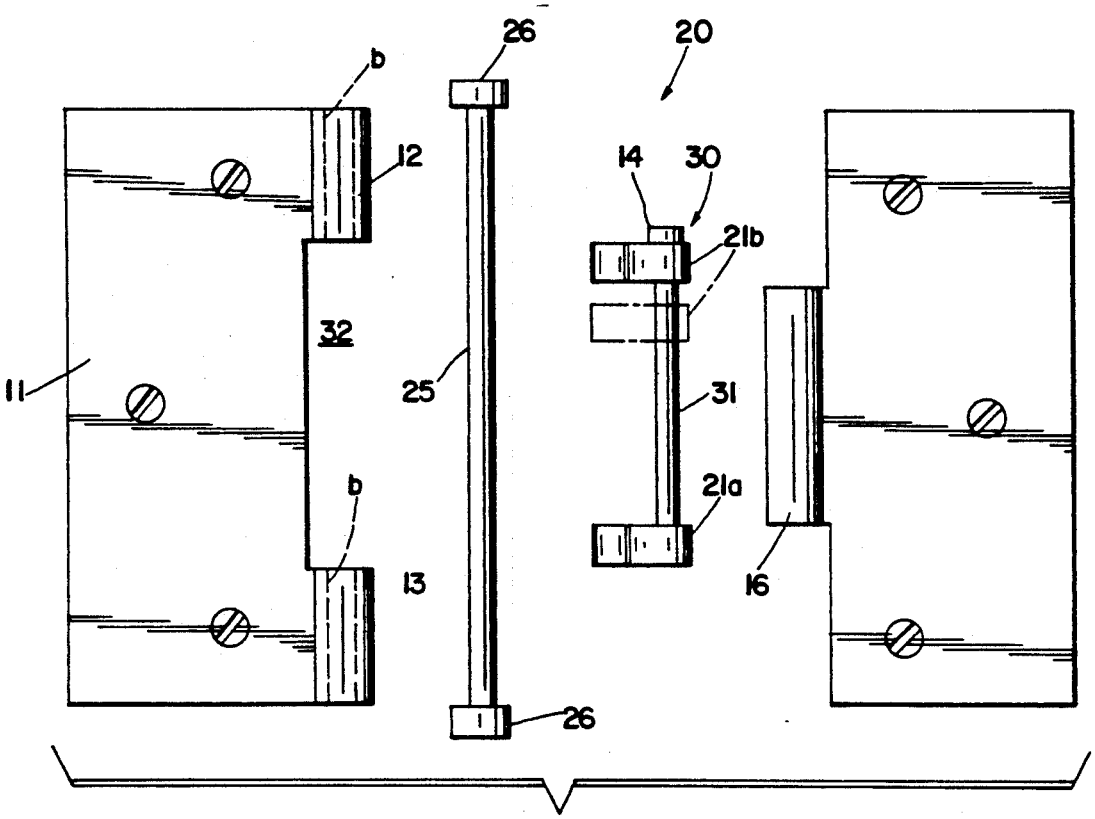
FIG. 1 is an exploded plan view of the key and associated hinge parts of the invention.
Figure 3:
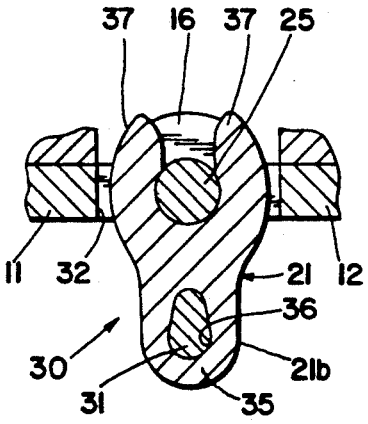
FIG. 3 is a sectional view taken from the line 3—3 of the clips or clasps of FIGS. 1 and 2.

The clips are generally of arch form as best shown in FIG. 3 with the voussoir 35 of each apertured at 36 to permit the rod of the key to pass through the opening 36 provided in the voussoir 35 wherefor the clips are adapted to be suspended from the rod depending from the rod or key 30. The clips shown are provided with spaced legs or hooks 37 adapted to be snugly and selectively clamped, as shown over the pin, to provide for a selected location of the door with respect to the jamb to which the leaves are secured. The clips are dimensioned so that when they are seated in pairs as in FIGS. 4 and 5 they close the space provided between the central knuckle 16 and an end knuckle 12 or 13. One of the clips **21*a* is securely mounted on an end of the rod and as shown in FIG. 1 and the other clip 21*b*** is adapted to be moved longitudinally on the said rod to be either brought into contact with the other clip seated in space provided between a knuckle on the first leaf and a substantially centrally disposed knuckle on the second leaf as referred to hereinbefore to seat both clips therein or to be placed into space afforded between the centrally disposed knuckle on the second leaf and an end knuckle on the first leaf wherefor each clip is inserted into divided space allowed at either of the ends of the rod. It is to be noted that the clips are as shown in FIG. 2.

The voussoir 35 of the arch of the clip affords a handle for easy lifting or removal of the arch shaped clips into or from whichever space or spaces in which the clips are disposed to raise or lower the door or cabinet to which the butt hinge is secured as referred to hereinbefore. See FIGS. 4 and 5.

It will be observed that in the invention the hinge may be moved to establish limits for raising or lowering the door and to raise or lower the same without removal of the pin on which the knuckles of the leaves are mounted. See FIGS. 4 and 5.

It is contemplated that the hinges can be of preferred sizes and with optional spaces to accommodate different heights for the door.

While I have described my invention in connection with a preferred embodiment, I am aware that numerous and extensive departures may be made therein without however departing from the spirit of my invention or the scope of the appended claims.

What I claim is:

1. A key for a butt hinge which hinge comprises a pair of leaves, the first of said leaves having two axially aligned spaced knuckles, a second of said leaves having a knuckle adapted to be interposed in spaced relation to one of the pair of the knuckles, a pin extending through said knuckles, a lock on said pin, said key comprising a rod, a pair of clips, said clips being carried by said rod and adapted to be brought selectively into space provided between any of said knuckles wherein one of said pair of clips is slidably mounted on said rod and adapted to be moved relative to the other clip and wherein the key is employed to enable one of said leaves to be raised or lowered with respect to the other of said leaves.

2. A key for a hinge as in claim 1 wherein a pair of said clips is mounted in end-to-end contact at one end of said rod to close the space.

3. A key for a hinge as in claim 2 wherein one of said pair of clips is adapted to be mounted in space provided adjacent each end of the interposed knuckles.

* * * * *